US007178864B2

(12) United States Patent
Hsieh

(10) Patent No.: US 7,178,864 B2
(45) Date of Patent: Feb. 20, 2007

(54) FOLDABLE CHAIR HAVING A DETACHABLE FABRIC SHEET

(75) Inventor: Duan-Cheng Hsieh, Taipei (TW)

(73) Assignee: Habitex Corporation, Taipei (TW)

( * ) Notice: Subject to any disclaimer, the term of this patent is extended or adjusted under 35 U.S.C. 154(b) by 56 days.

(21) Appl. No.: 11/106,905

(22) Filed: Apr. 15, 2005

(65) Prior Publication Data

US 2006/0232108 A1 Oct. 19, 2006

(51) Int. Cl.
*A47C 4/28* (2006.01)
*A47C 4/30* (2006.01)
*A47C 4/36* (2006.01)
*A47C 4/44* (2006.01)

(52) U.S. Cl. ..... 297/45; 297/228.11; 297/228.12

(58) Field of Classification Search ..... 297/45, 297/228.11, 228.12
See application file for complete search history.

(56) References Cited

U.S. PATENT DOCUMENTS 2,916,744 A * 12/1959 May et al. ..... 297/45 X
3,003,816 A * 10/1961 Harrison ..... 297/228.11
D267,523 S * 1/1983 Neilson ..... 297/228.11 X
4,396,227 A * 8/1983 Neilson ..... 297/228.11
5,320,404 A * 6/1994 Le Gal ..... 297/16.2
5,320,407 A * 6/1994 Tell ..... 297/228.11
5,333,921 A * 8/1994 Dinsmoor, III ..... 297/228.11 X
5,339,748 A * 8/1994 Bilotti ..... 297/228.11 X
5,496,094 A * 3/1996 Schwartzkopf et al. ..... 297/45
6,332,646 B1 * 12/2001 Tseng ..... 297/16.1
6,447,057 B1 * 9/2002 Chen ..... 297/45 X
6,848,740 B1 * 2/2005 Reese ..... 297/45 X
7,011,372 B1 * 3/2006 Hsieh ..... 297/45 X
2003/0234561 A1 * 12/2003 Zheg ..... 297/45

* cited by examiner

*Primary Examiner*—Rodney B. White
(74) *Attorney, Agent, or Firm*—Sampson & Associates, P.C.

(57) ABSTRACT

A foldable chair includes a frame body having a looped seat frame, and a fabric sheet having a rounded marginal portion. The marginal portion includes a plurality of angularly spaced-apart flaps, each having a sleeve section and a string inserted into the sleeve section. A releasable fastening unit is provided to connect a first end of the string of each flap to a second end of the string of an adjacent one of the flaps. The flaps are folded over the seat frame. The strings of the flaps form a loop after the first ends of the strings of the flaps are respectively connected to the second ends of the strings of the flaps. The loop has a cross section smaller than that of the seat frame.

4 Claims, 5 Drawing Sheets

FOLDABLE CHAIR HAVING A DETACHABLE FABRIC SHEET

BACKGROUND OF THE INVENTION

1. Field of the Invention

The invention relates to a chair, more particularly to a foldable chair that has a detachable fabric sheet.

2. Description of the Related Art

Referring to FIG. 1, a conventional chair 1 usually includes a support frame 11 mounted on the ground, and a seat cushion 12 supported on the support frame 11. The seat cushion 12 is made by covering a sponge layer 121 with a synthetic leather layer 122 to provide comfort to a user. However, the seat cushion 12 is not breathable, and the sponge layer 121 and the synthetic leather layer 122 are often permanently deformed due to different loads they bear, leading to discomfort when seated on the conventional chair 1.

Referring to FIG. 2, another conventional chair 2 includes an intersecting leg frame 221, a ring member 222 mounted on top ends of the leg frame 221, and a seat cushion 21 sleeved on the ring member 222. The ring member 222 is formed by interconnecting a plurality of ring sections 223. The seat cushion 21 is made by molding a fabric sheet 211 into a bowl-shaped fabric cushion, which corresponds to the sitting posture of a user. However, to assemble the fabric sheet 211 and the ring member 222, the connection between each two adjacent ones of the ring sections 223 must first be removed, followed by insertion of each ring section 223 into the fabric sheet 211, then connection of each two adjacent ones of the ring sections 223. Hence, assembly of the seat cushion 21 and the ring member 222 is both complicated and time-consuming.

SUMMARY OF THE INVENTION

Therefore, the object of the present invention is to provide a foldable chair that has a frame body and a fabric sheet that maybe quickly attached to and removed from the frame body.

According to this invention, a foldable chair comprises a frame body, a fabric sheet, a plurality of strings, and a releasable fastening unit. The frame body has a looped seat frame, and a leg frame connected to the seat frame. The fabric sheet includes an inner region, and a rounded marginal portion surrounding the inner region for attachment to the looped seat frame. The marginal portion includes a plurality of angularly spaced-apart flaps disposed along the marginal portion, and a plurality of cutout portions, each of which is formed between two adjacent ones of the flaps. Each of the flaps has a sleeve section, and a string inserted into the sleeve section. The string has first and second ends extending out of the sleeve section. The releasable fastening unit is provided to connect the first end of the string of each of the flaps to the second end of the string of an adjacent one of the flaps. The flaps are folded over the looped seat frame. The strings of the flaps form a loop after the first ends of the strings of the flaps are respectively connected to the second ends of the strings of the flaps. The loop has a cross section smaller than that of the looped seat frame.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
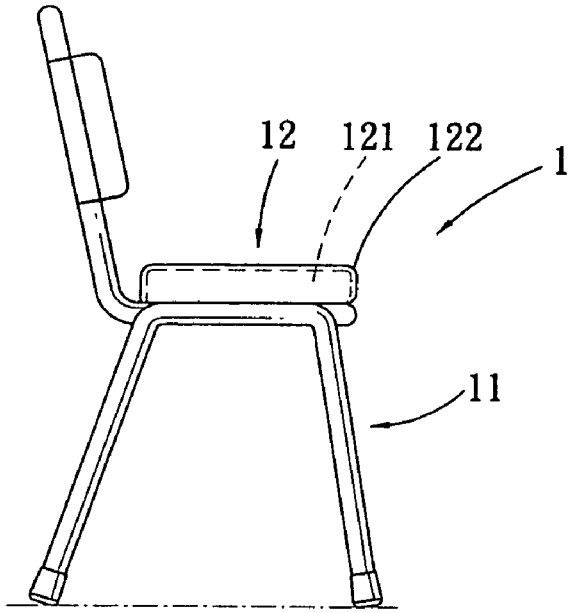
PRIOR ART FIG. 1
FIG. 1 is a schematic side view of a conventional chair.
Figure 2:
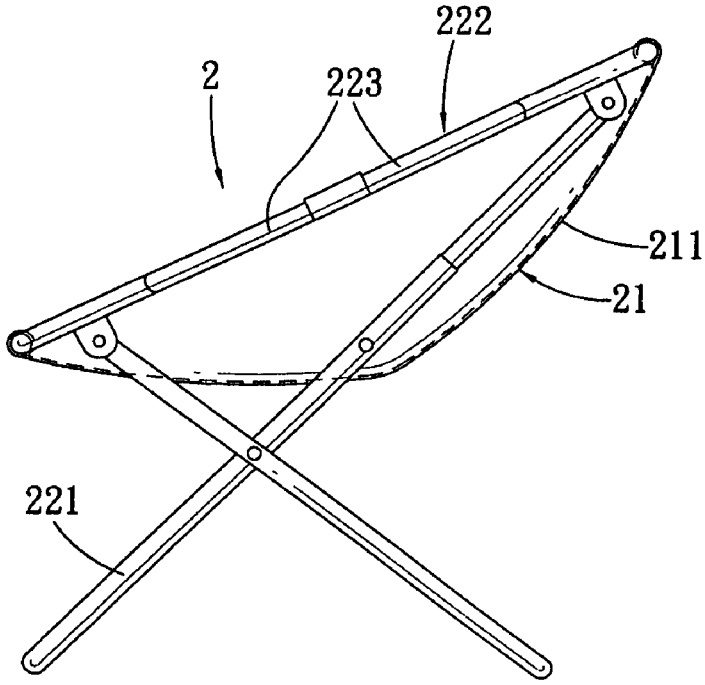
PRIOR ART FIG. 2
FIG. 2 is a schematic side view of another conventional chair.
Figure 3:
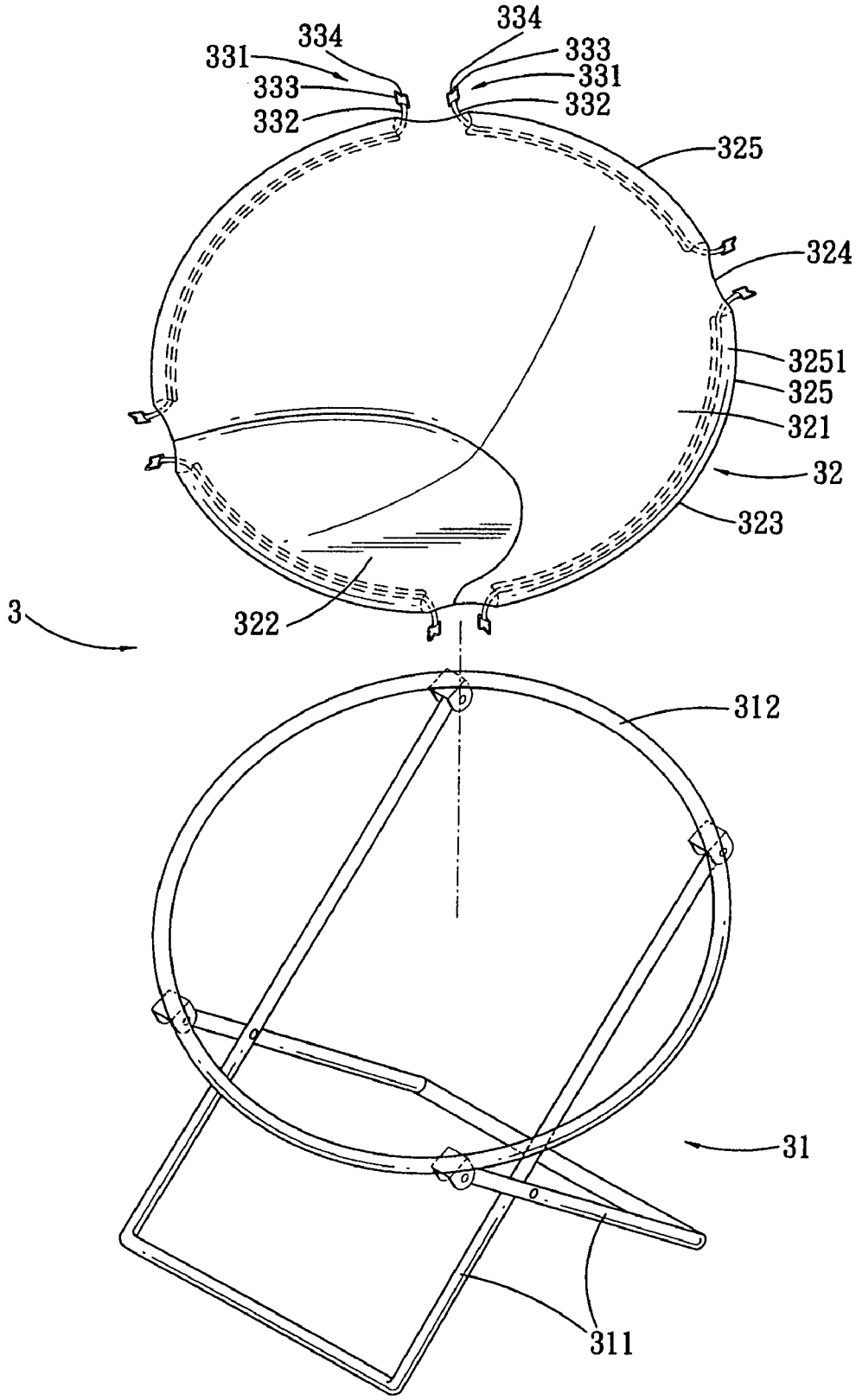
FIG. 3 is an exploded perspective view of the preferred embodiment of a foldable chair according to the present invention.
Figure 4:
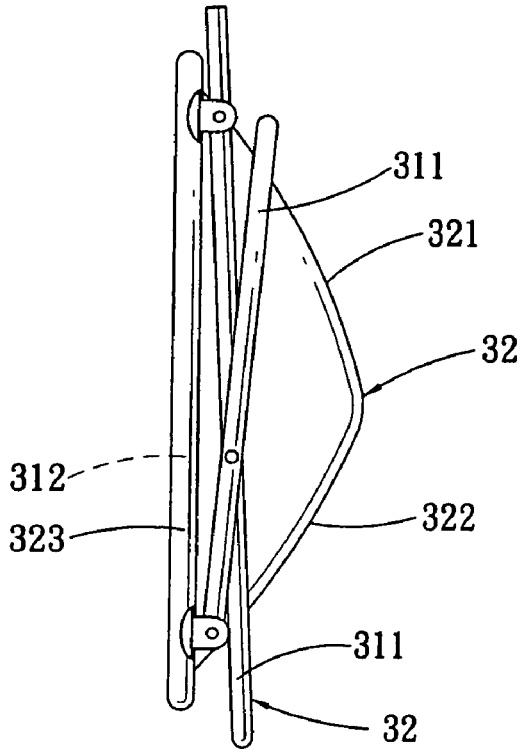
FIG. 4 is a schematic view of the preferred embodiment in a folded state.

Referring to FIGS. 3 and 4, the preferred embodiment of a foldable chair 3 according to the present invention is shown to comprise a frame body 31 and a fabric sheet 32.

The frame body 31 has a looped seat frame 312 and a leg frame. The leg frame includes two intersecting U-shaped legs 311 that are connected pivotally to each other. Each of the U-shaped legs 311 has two top ends connected pivotally to the looped seat frame 312. Through such connections, the frame body 31 can be folded, as shown in FIG. 4, and unfolded, as shown in FIG. 3.

The fabric sheet 32 includes an inner region, and a rounded marginal portion 323 surrounding the inner region for attachment to the looped seat frame 312. The inner region includes a seat portion 322, and a backrest portion 321 connected to and extending upwardly from the seat portion 322. The rounded marginal portion 323 includes a plurality of angularly spaced-apart flaps 325 disposed along the marginal portion 323, and a plurality of cutout portions 324, each of which is formed between two adjacent ones of the flaps 325. Each of the flaps 325 has a sleeve section 3251, and a string 332 inserted into the sleeve section 3251. The string 332 of each flap 325 is non-elastic and non-stretchable, and has first and second ends extending respectively out of two opposite ends of the sleeve section 3251.

A releasable fastening unit includes a plurality of buckles 331, each of which includes two interengageable buckle elements 333, each, in turn, having a hooking end 334. Each of the buckle elements 333 is fixed to 5 either the first or second end of a corresponding one of the strings 332 of each flap 325, thereby enabling connection between the first end of the string 332 of one of the flaps 325 and the second end of the string 332 of an adjacent one of the flaps 325.

Figure 5:
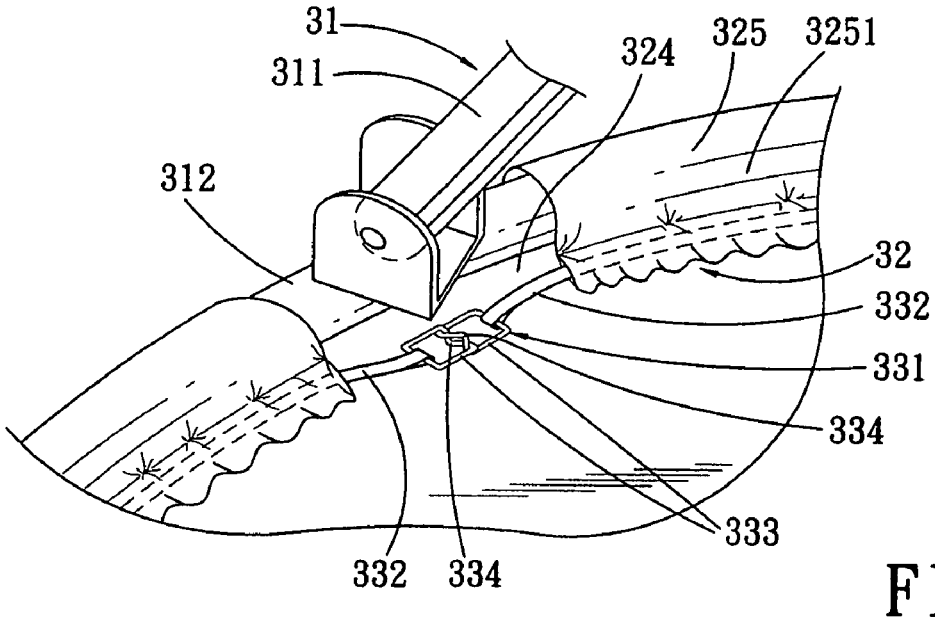
FIG. 5 is a fragmentary enlarged perspective view of the preferred embodiment, illustrating assembly of a fabric sheet and a looped seat frame.
Figure 6:
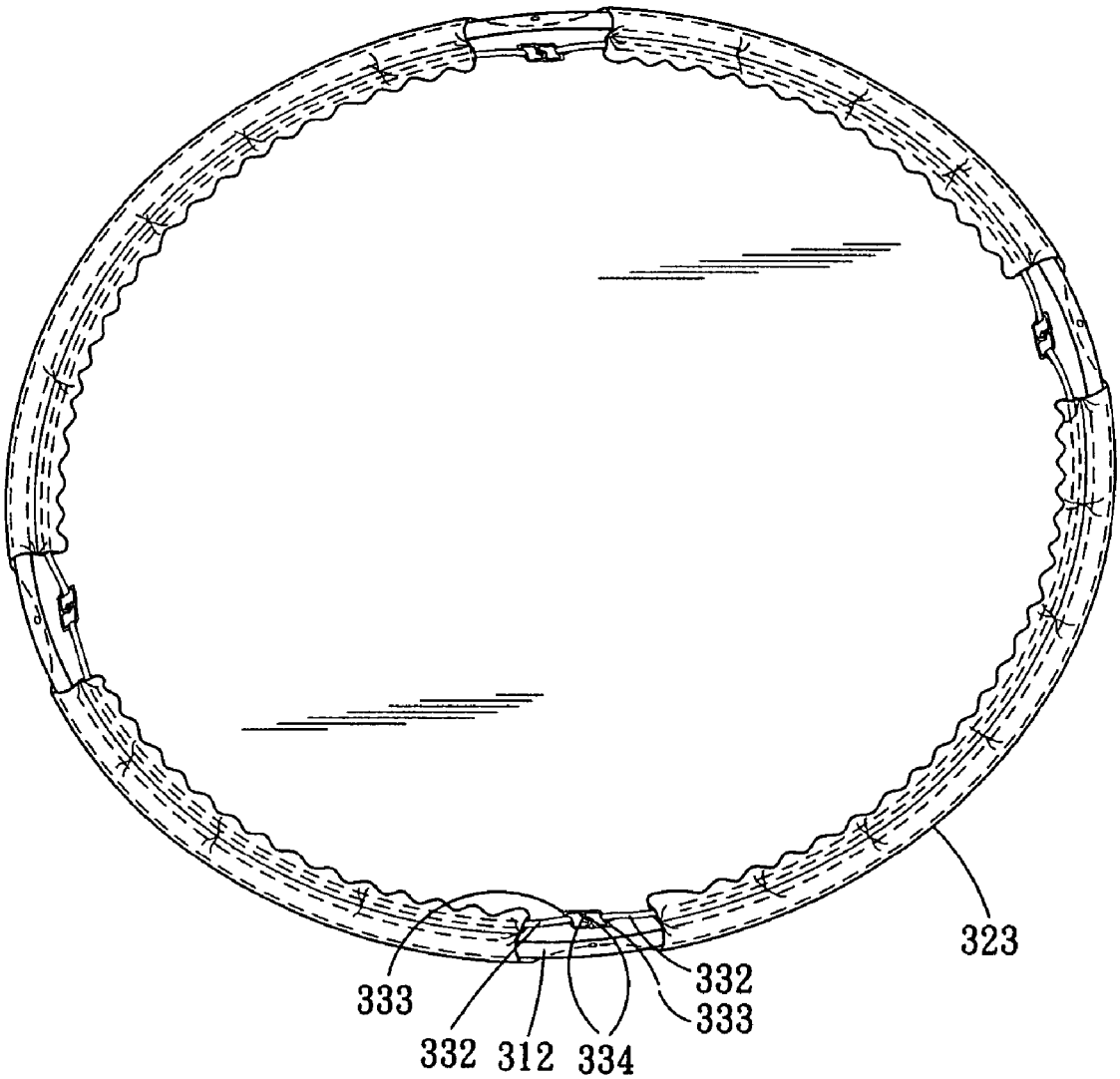
FIG. 6 is a schematic rear view of the preferred embodiment, illustrating how the fabric sheet is positioned on the looped seat frame.

Referring to FIGS. 5 and 6, to attach the fabric sheet 32 on the frame body 3l, the flaps 325 of the marginal portion 323 of the fabric sheet 32 are first folded over the looped seat frame 312 of the frame body 31, after which the hooking ends 334 of the buckle elements 333 of the buckles 331 are interengaged. After the first ends of the strings 332 of the flaps 325 are respectively connected to the second ends of the strings 332 of the flaps 325 through the buckles 331, the strings 332 of the flaps 325 form a loop, which has a cross section smaller than that of the looped seat frame 312. At this time, the marginal portion 323 covers completely the looped seat frame 312.

Figure 7:
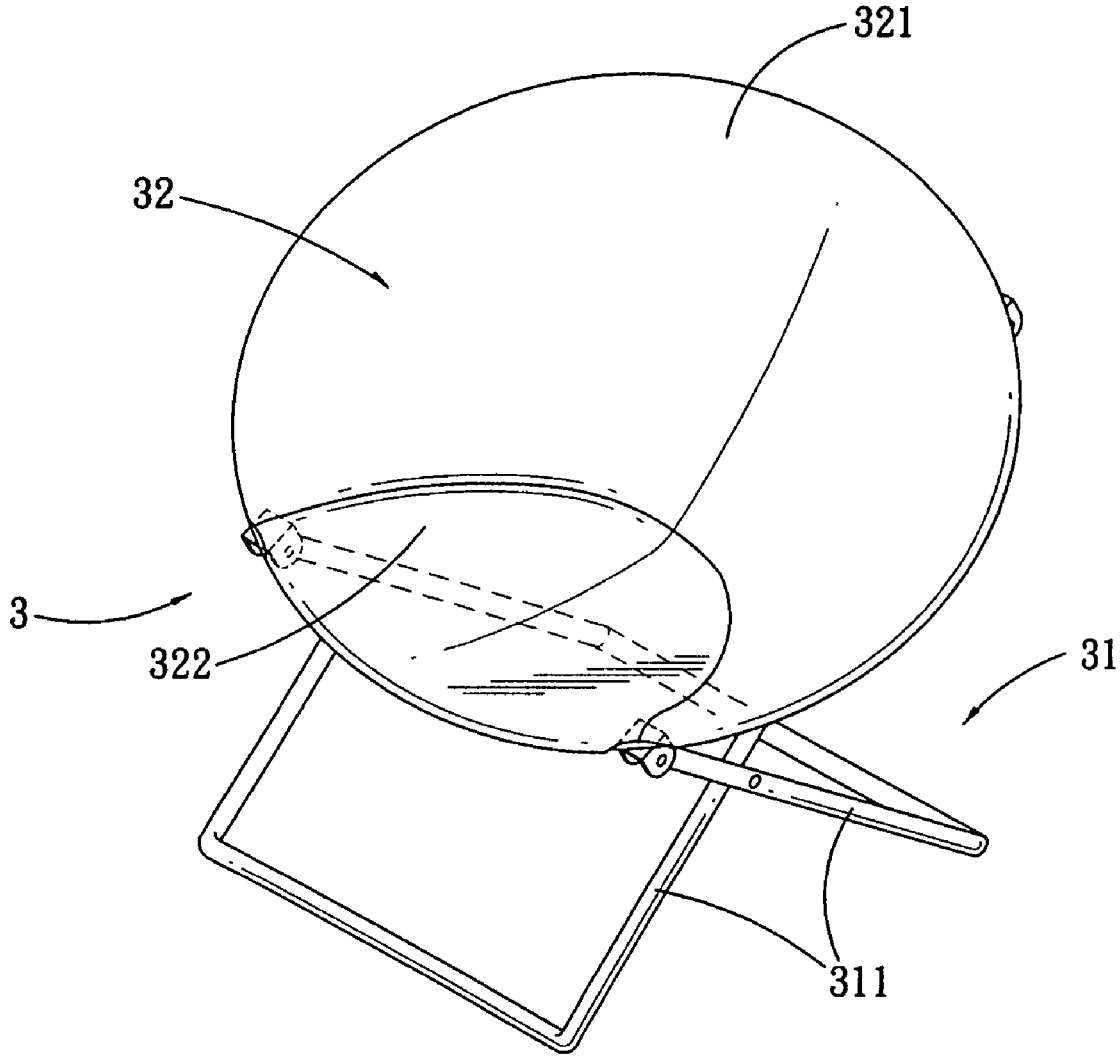
FIG. 7 is a perspective view of the preferred embodiment in an unfolded state.

Referring to FIG. 7, when the foldable chair 3 is in the unfolded state, the fabric sheet 32 forms a bowl-shaped configuration. Since the fabric sheet 32 is made of a flexible material, when a user sits on the seat portion 322 of the fabric sheet 32, the fabric sheet 32 conforms to the body shape of the user. The degree of deformation at this time is determined by the weight of the user. Further, the backrest portion 321 of the fabric sheet 32 contacts the body of the user to provide additional comfort.

The user can quickly remove the fabric sheet 32 from the looped seat frame 312 by simply disengaging all the hook ends 334 of the buckle elements 333 of the buckles 331. This facilitates cleaning of the fabric sheet 32 and storing of the foldable chair 3. When a plurality of the foldable chairs 3 are to be stored, the fabric sheet 32 of each foldable chair 3 is first removed, then the frame bodies 31 of the foldable chairs 3 are folded. The frame bodies 31 may then be arranged in a stack. Hence, the foldable chairs 3 are very easy to store, and do not occupy much space.

From the aforementioned description, it is apparent that the foldable chair 3 of the present invention is provided with a plurality of interengageable buckle elements 333 on the flaps 325 of the marginal portion 323 of the fabric sheet 32 so that the fabric sheet 32 can be quickly attached to and removed from the frame body 31 of the foldable chair 3. Moreover, when all the buckle elements 333 are interengaged, the fabric sheet 32 is positioned on the frame body 31, and forms a bowl-shaped configuration. Since the fabric sheet 32 is made of a flexible material, it conforms to the body shape of the user to fully support the user's body, thereby providing comfort to the user when seated.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foldable chair comprising:

a frame body having a looped seat frame, and a leg frame connected to said seat frame;

a fabric sheet including an inner region, and a rounded marginal portion surrounding said inner region for attachment to said looped seat frame, said marginal portion including a plurality of angularly spaced-apart flaps disposed along said marginal portion, and a plurality of cutout portions, each of which is formed between two adjacent ones of said flaps, each of said flaps having a sleeve section, and a string inserted into said sleeve section, said string having first and second ends extending out of said sleeve section; and a releasable fastening unit to connect said first end of said string of each of said flaps to said second end of said string of an adjacent one of said flaps, said flaps being folded over said looped seat frame, said strings of said flaps forming a loop after said first ends of said strings of said flaps are respectively connected to said second ends of said strings of said flaps, said loop having a cross section smaller than that of said looped seat frame.

2. The foldable chair as claimed in claim 1, wherein said string is non-elastic and non-stretchable.

3. The foldable chair as claimed in claim 1, wherein said fastening unit includes a plurality of buckles, each of which connects said first end of said string of one of said flaps to said second end of said string of an adjacent one of said flaps, each of said buckles including two interengageable buckle elements.

4. The foldable chair as claimed in claim 1, wherein said inner region includes a seat portion, and a backrest portion connected to said seat portion.

* * * * *